United States Patent [19]

Greene et al.

[11] Patent Number: 4,887,821

[45] Date of Patent: Dec. 19, 1989

[54] GAME BALL SETTING APPARATUS

[76] Inventors: James E. Greene, P.O. Box 252; James H. Johnson, Rte. 1, Box 51E, both of Reardan, Wash. 99029

[21] Appl. No.: 224,062

[22] Filed: Jul. 25, 1988

[51] Int. Cl.[4] ..... A63B 69/00

[52] U.S. Cl. ..... 273/411

[58] Field of Search ..... 273/411, 1.5 A, 29 A

[56] References Cited

U.S. PATENT DOCUMENTS

| | | | |
|---|---|---|---|
| 773,167 | 0/1904 | Spink | 273/411 |
| 3,897,950 | 0/1975 | Keller | 273/411 |
| 4,022,471 | 0/1977 | Keller | 273/411 |
| 4,296,925 | 0/1981 | Alston | 273/1.5 A |
| 4,372,561 | 0/1983 | Morgan et al. | 273/411 |

*Primary Examiner*—William H. Grieb

*Attorney, Agent, or Firm*—Wells, St. John & Roberts

[57] ABSTRACT

A game ball setting apparatus is described for mounting a game ball support to a support structure for selective elevational adjustment. In the preferred form, a base frame is provided that will releasably attach to the support structure, and a ball support frame is removably attachable to the base frame. An adjustment mechanism is provided on the base frame that facilitates selective elevational adjustment of the ball support frame from a user support platform on the support structure. Mounting mechanisms are also provided on the base frame in the preferred form that facilitate mounting and dismounting of the base frame and ball support frame to the support structure.

21 Claims, 4 Drawing Sheets

16
11
17

48
10
46
45
19
18
42
54
39
23
14
49
40
12
41
27
52
13
15
24
40
20
43

14
52
25
39
34
40
36
38
22
49
45
24
43
18
20

GAME BALL SETTING APPARATUS

TECHNICAL FIELD

The present invention relates to setting or supporting of a game ball at a location for play practice as, for example, supporting a volleyball at an elevation for practicing spiking plays.

BACKGROUND OF THE INVENTION

In the game of volleyball "spike" plays and plays defending against a spiked ball are perhaps the most important and difficult plays to learn and perfect. Coaching is especially difficult since the plays involve split second timing with much of each play being completed at jumping height from the floor. To be effective, the coach must be alert to the player's approach as proper foot work, arm and trunk motion are important. The coach must also especially note the hand and wrist orientation at ball impact. All these observations are very difficult to make on a consistent basis without maintaining control of the ball at a "set" location.

Responsive to the above problems, various training apparatus have been developed to support a game ball at a selected elevation for practice purposes. For example, a typical volleyball training aid includes an upright post extending from a weighted base. A lateral arm extends outward from the post to a ball support. Such apparatus though bulky and difficult to store functions adequately to support a ball at a consistent jumping height elevation for practice purposes.

A problem realized with current ball supporting apparatus is that the ball being at the jump height of the user, presents a problem in loading balls onto the apparatus. A typical solution is to use a stepladder or chair alongside the ball support. However the chair or stepladder creates an undesirable obstruction and distraction to the practicing player.

Some practice devices, as a solution to the loading problem, make use of tethered balls. A practice ball is connected by a tether line to the ball support and either will not leave the ball support, or will move only a short distance upon being struck. This provides a solution to the loading problem but adds additional problems in that tethers do not usually allow the ball to move along its natural flight path, so it is difficult to tell the direction of hit. Furthermore, the tether has a tendency to inhibit or obstruct the impact area in many cases and will therefore adversely affect initial direction of the ball movement.

Another problem exists with conventional ball setting apparatus. The physical capabilities and height of individual players vary substantially. Therefore the setting height of the ball for effective training must be readily adjustable. Equipment that provides ready adjustment has not previously available. Various forms of slow to operate interlocking telescoping arrangements using set screws and the like have been utilized. While such adjustments will function adequately to selectively set the operating height of the ball support, most are frustratingly slow or difficult to operate. Consequently, coaches often succumb to the temptation of setting the training apparatus at a preselected height and requiring all players to practice at that specific height.

From the above, it may be realized that a need remains for an easily transportable, compact ball setting device that will mount to a readily available support such as a volleyball referee stand or that alternatively is an integral part of a structure having a user support platform and that will enable the coach or another to stand with unobstructed visual access to an elevated ball support and that will enable the ball support to be easily loaded. There is a further need for such a device that provides the ability for fast and accurate elevation adjustment for the ball support to accommodate practicing players having different heights and jump capabilities.

BRIEF DESCRIPTION OF THE DRAWINGS

Preferred embodiments of the invention are illustrated in the accompanying drawings, in which.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

Figure 1:
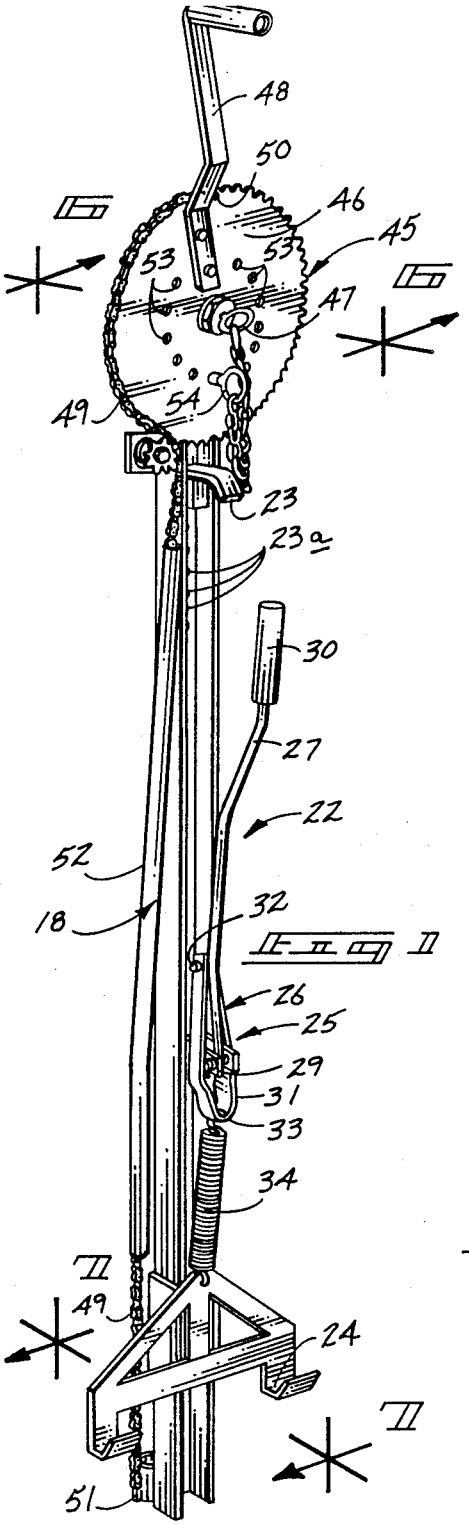
FIG. 1 is a perspective view of a base frame including mounting and adjusting mechanisms of a preferred form of the present invention.
Figure 2:
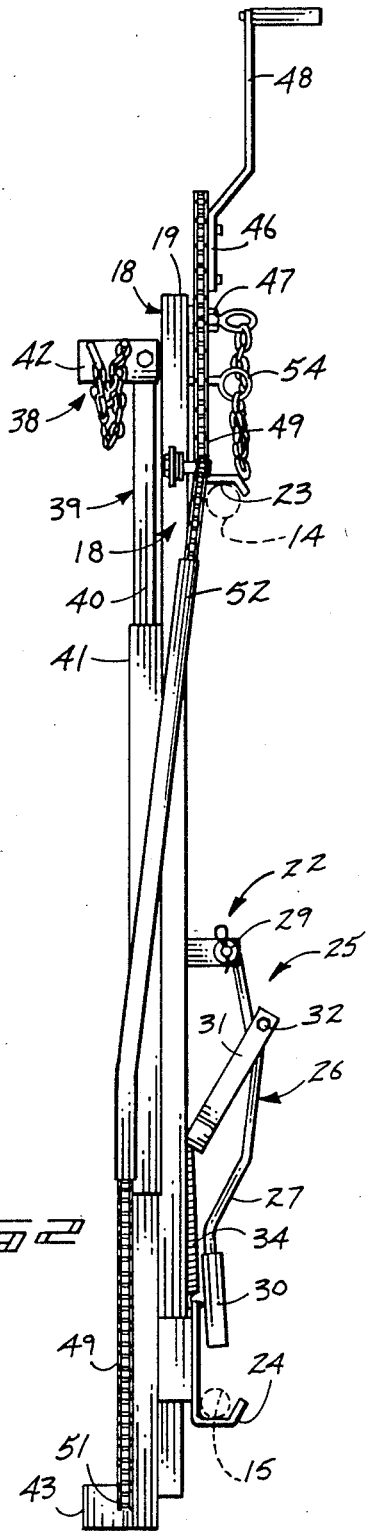
FIG. 2 is a side elevation view of the components illustrated in FIG. 1.
Figures 3, 7:
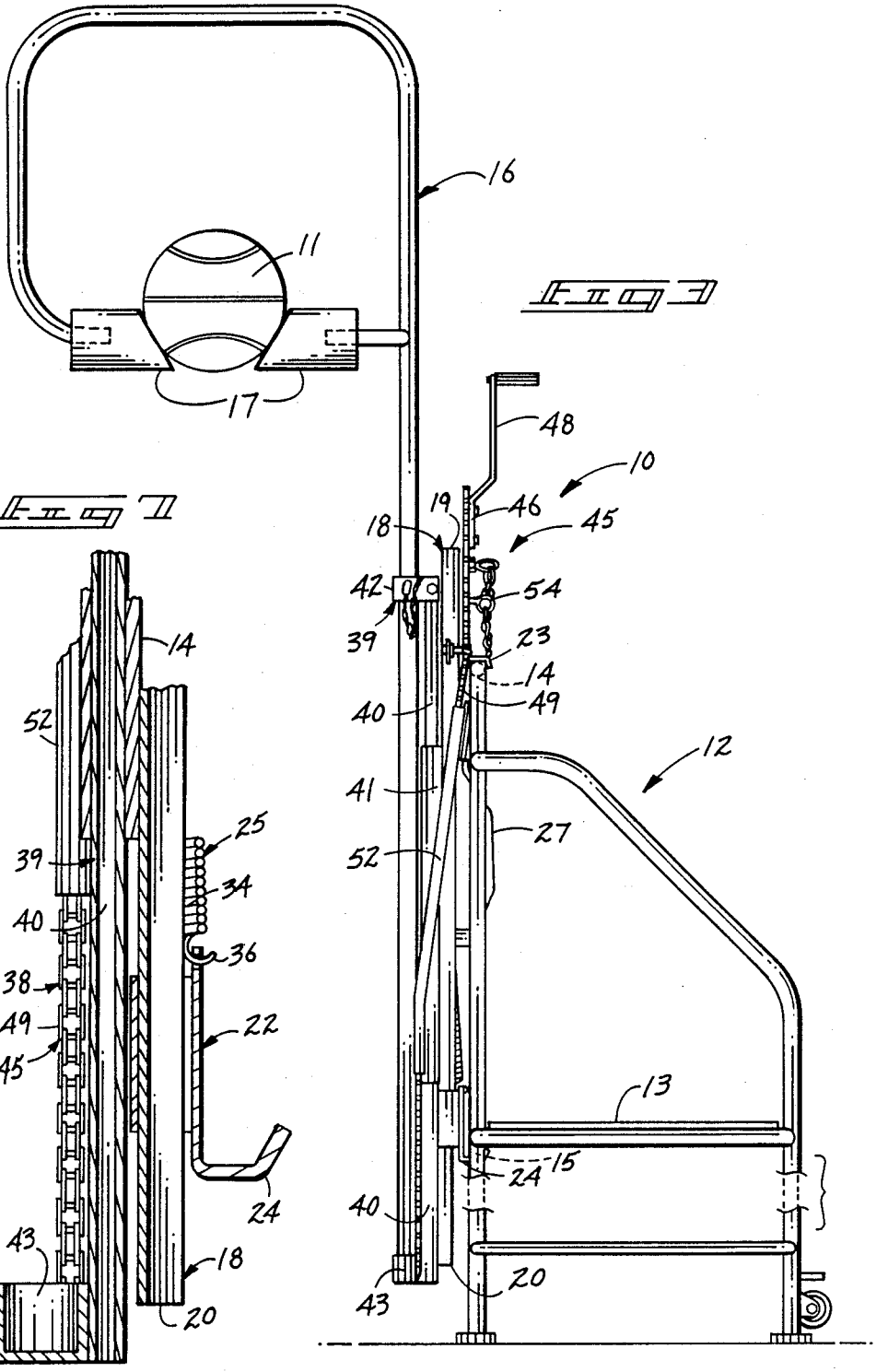
FIG. 3 is a side elevation view illustrating the present invention assembled and mounted to a referee stand.
FIG. 7 is an enlarged fragmented sectional view taken substantially along lines 7—7 in FIG. 1.

A basic form of the present game ball setting apparatus is shown in FIGS 1 and 2 and is generally designated therein by the reference numeral 10 in the drawings. The apparatus 10 is provided to mount a game ball support 16 to a structure as illustrated in FIG. 3. Alternatively apparatus 10 may be integrated with the support and/or structure as disclosed herein. All forms of the present apparatus are utilized to support a game ball 11 at a set elevation in relation to a floor surface.

The preferred form of apparatus 10 is releasably mountable to a support structure 12 such as a volleyball referee stand. The stand will include an elevated user support platform 13 that will support an assistant at a height facilitating loading of the game ball 11. The structure 12 as illustrated also includes a top horizontal rung 14 and a downwardly spaced second rung 15 for releasably mounting the preferred apparatus 10. The structure is preferably formed of rigid interfitting structural members of a lightweight material such as aluminum tubing or channel.

In the preferred form, the game ball setting apparatus 10 functions to releasably mount the ball support frame 16. The ball support frame 16 includes a ball support surface 17 thereon. The surface 17 may be a conventional form of ball support comprised of soft foam having sufficient rigidity to support the ball but resilient to avoid injury to a practicing player should the foam surfaces inadvertently be struck.

The present apparatus 10 includes an elongated base frame member 18 for releasably mounting the ball support frame 16 to the structure 12. The base frame 18 includes an elongated rigid metal channel extending between a top end 19 and a bottom end 20. A support structure mounting bracket assembly 22 and a ball support frame mounting bracket 39 are included on the base frame 18 as means for releasably attaching the ball support frame 16 to a structure such as the referee stand.

The support structure mounting bracket assembly 22 includes a first mount or hook member 23 and a second mount or hook member 24 on the elongated base frame member. One of the hooks 23 or 24 is preferably slidably mounted on the base frame for movement relative to the other which is preferably rigid on the base frame 18. The movable hook member is advantageously the lower hook member 24, and is connected to the base frame by a clamp assembly 25. Hook member 24 and clamp assembly 25 facilitate selective clamping action to secure the hook members to the support structure 12.

Figure 6:
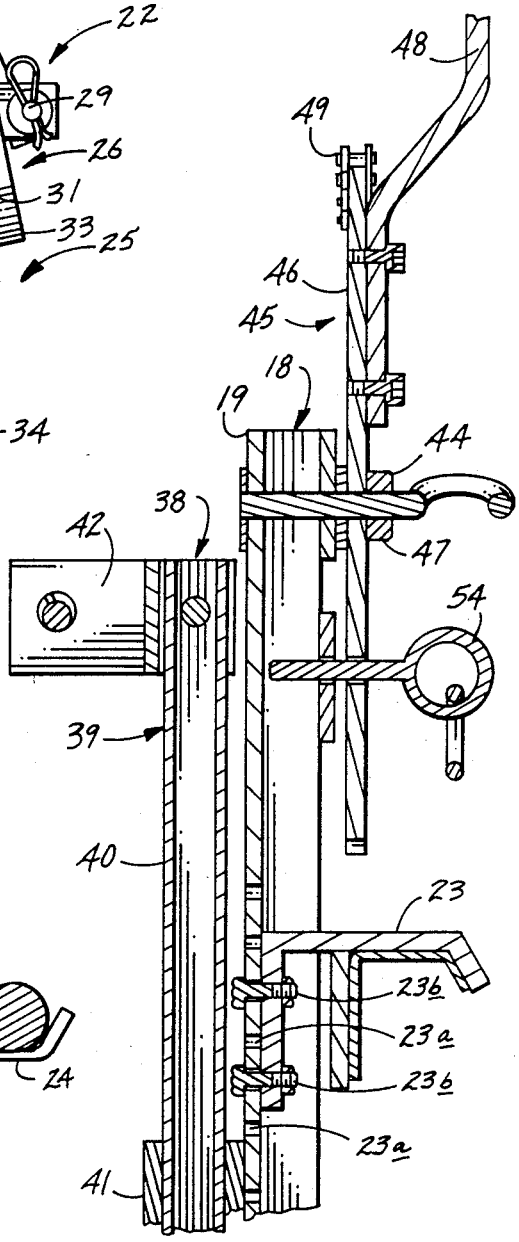
FIG. 6 is an enlarged fragmented sectional view taken substantially along lines 6—6 in FIG. 1.

The first hook member 23 is stationary on the frame to facilitate hanging of the base frame over the top horizontal rung 14 of the structure 12. The stationary position of hook 23 may be adjusted along the base frame through provision of a number of mounting holes **23*a* and bolt assemblies 23*b* (FIG. 6), to accommodate stands having various spacing between rungs 14**.

Figure 4:
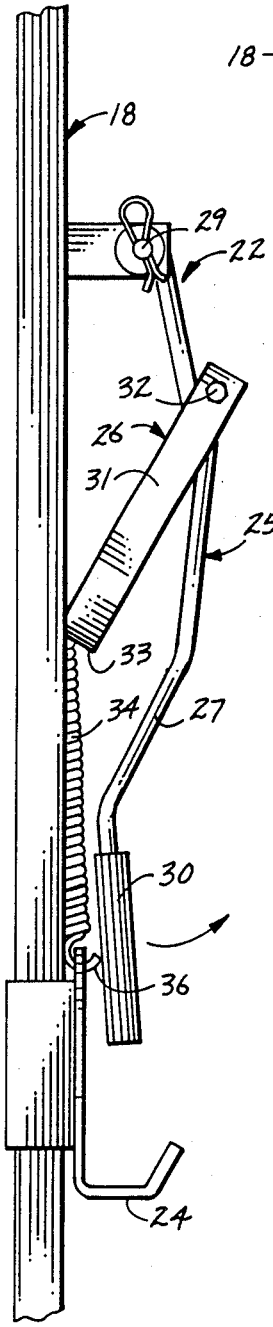
FIG. 4 is an enlarged fragmented view illustrating a mechanism for mounting the present ball setting apparatus to a support structure such as a referee stand.

The second hook member 24 can be selectively secured to the lower horizontal rung 15 by action of the clamp assembly 25. The clamp assembly 25 includes a toggle linkage 26. Linkage 26 is operable to selectively shift the second hook member 24 between operative and inoperative positions. The inoperative position is illustrated in FIGS. 2 and 4 wherein the toggle mechanism is shown in a release or inoperative position to facilitate reception of the second hook member over the rung 15. An operative position is illustrated in FIGS. 1, 3 and 5 in which the toggle mechanism has been operated to yieldably urge the second hook member 24 upwardly against the rung 15, thereby securing the base frame member to the referee stand.

The toggle linkage 26 includes a handle 27 pivoted at 29 to the base frame member 18. An opposite end of the handle includes a handgrip 30. A link 31 is pivotably mounted to the handle 27 at a link pivot 32. Link 31 extends to an end 33 opposite pivot 32. The link end 33 is connected to the top end of a tension spring 34. A bottom end 36 of the spring 34 is mounted to the second hook member 24.

Arcuate movement of the handle 27 about its pivot 29 will be translated through the spring 34 to shift the hook member 24 between inoperative (FIG. 4) and operative (FIG. 5) conditions. The spring is naturally contracted and the handle 27 is down in the inoperative condition, thereby allowing the hook to be fitted over the rung 15. The spring is stretched under tension and the handle is up in the operative condition thereby urging the hooks 23, 24 together to securely clamp the base frame to the rungs 14, 15.

Figure 5:
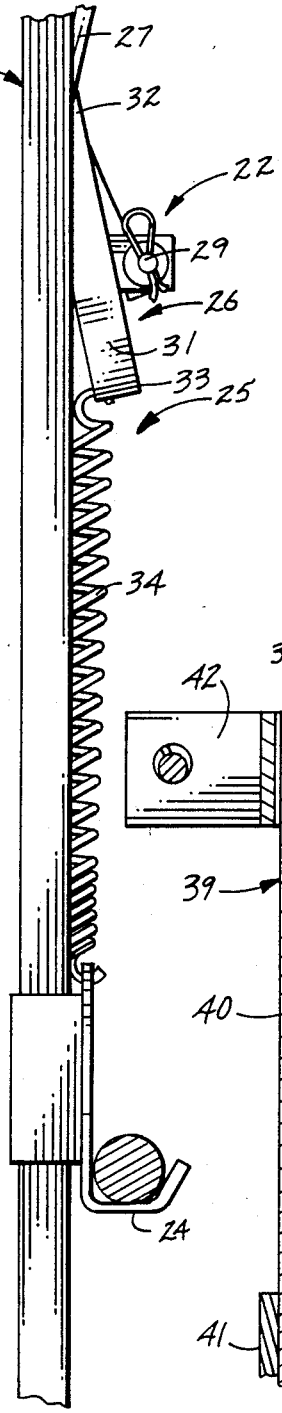
FIG. 5 is an operational view of the mechanism shown in FIG. 4.

It may be noted that the toggle mechanism illustrated in FIGS. 4 and 5 functions with an "over center" locking capability when in the operative condition. In the operative condition, the toggle link pivot 32 is shifted over center with respect to the handle pivot 29 and directional tension offered by spring 34. Tension of the spring 34 will thus urge the handle 27 against the base frame member and thereby effectively hold the handle up in its operative condition. Spring tension must therefore be overcome before the handle can be pivoted back to the inoperative, release position. This feature facilitates quick and secure clamping of the apparatus to a support structure.

The support structure mounting bracket assembly 22 is situated to one side of the base frame 18. The opposite side of the base frame includes an adjustment means 38. Means 38 is utilized to receive and mount the ball support frame 16 for access from the user's support platform 13 and for selective elevational adjustment of the ball support surface 17.

Adjustment means 38 includes a ball support frame mounting bracket 39 preferably situated adjacent the bottom end of the base frame member and that is slidably mounted thereto. The bracket 39 will slide longitudinally along the base frame member responsive to operation of the adjustment means.

Bracket 39 includes an elongated rod 40 (FIG. 7) that extends upwardly along the base frame. The rod 40 is slidably received within a guide channel 41 on the base frame 18. The rod and guide facilitate longitudinal motion of the bracket along the base frame.

A clip and pin arrangement 42 is situated at a top end of the elongated rod 40. The clip and pin arrangement are provided to receive the ball support frame 16 and secure it is an upright orientation in relation to the base frame. The pin of the clip and pin assembly 42 is releasably received through the frame to selectively secure the ball support frame in the upright orientation. The bottom end of the ball support frame is releasably received within a frame receiving pocket 43 on the bottom end of the rod 40. The pocket 43 and the clip and pin arrangement 42 facilitate releasable reception of the ball support frame, to facilitate ease in mounting the apparatus to the support structure 12.

Adjustment means 38 further includes a linkage 45 connecting the ball support frame mounting bracket 39 to the base frame 18. Linkage 45 is manually operable to selectively move the ball support frame mounting bracket 39 and the attached ball support frame 16 elevationally along the base frame.

The linkage 45 is preferably comprised of a sprocket 46 rotatably mounted by an axle 47 to the upward end of the base frame 18. A handle 48 is secured to the sprocket to facilitate rotation. The handle shown in the drawings is preferred to facilitate manual rotation of the sprocket. However, it is contemplated that other forms of rotational mechanisms may be provided, including, for example, a conventional electric drive motor and gearbox to facilitate the sprocket rotation.

A roller chain 49 is attached at one end 50 to the sprocket 46. The roller chain 49 engages the sprocket teeth and extends from end 50 to a remaining end 51. End 51 is mounted to the ball support frame mounting bracket 39. A guide tube 52 is provided to train the chain along the length of the base frame between the sprocket and bracket.

It may be understood from the above that rotation of the handle 48 will correspondingly cause the chain 49 to take up or let down the ball support frame mounting bracket 39. This facilitates selective elevational adjustment of the ball support frame and game ball in a quick and easy manner.

A selected elevation may be set by a lock mechanism comprising a series of holes 53 (FIG. 1) angularly spaced about the sprocket, and a pin 54 that is releasably received through any one of the holes 53 to engage the base frame 18. Height may therefore be adjusted by removing the pin, rotating the crank, and reinserting the pin once the desired elevation has been achieved.

Prior to operation, installation of the preferred form of the present apparatus is accomplished firstly by mounting the base frame and attached mechanism to the support structure 12. When utilized with a referee stand, this step is accomplished simply by lifting the first hook or mounting member 23 over the top horizontal rung 14 of the referee stand. The lower rung 15 will then be situated just slightly above the second hook members 24. At this time the handle 27 may be shifted upwardly and locked in the over-center position to pull the second hook member 24 upwardly against the lower rung 15. Spring tension will hold the second hook member 24 firmly against the lower rung and thereby secure the base frame to the support structure 12. As the handle is lifted upwardly, the link 31 will shift to an over center position as indicated in FIG. 5 and therefore effectively lock the second hook member in its operative position.

It is noted that the base frame member is first mounted to the support structure separately from the ball support frame 16. This is done to eliminate the additional weight of the support frame while the base frame is being mounted, thereby enabling installation of the apparatus by a single individual. Additionally, the separate nature of the base frame 18 and ball support frame 16 facilitates a compact condition when the apparatus is to be stored.

The ball support frame 16 may be easily mounted to the mounting bracket assembly 39 of the base frame simply by lifting the frame into position so the bottom end thereof will be releasably received within the ball support frame receiving pocket 43. The frame is then tipped up to a substantially vertical orientation to engage the clip of the clip and pin assembly 42. The pin of the clip and pin assembly is then inserted through the clip and the ball support frame to secure the ball support frame in position, thereby completing assembly. The apparatus is now ready for use.

The preferred form of the present apparatus is best utilized with a referee stand as support structure since a user may stand on the support platform 13 for easy access to the adjustment means 38 and for loading the game ball 11 onto the ball support surface 17.

A ball is loaded simply by lifting it onto the ball support surface 17 between the appropriate pad sections. If desirable, height of the ball from the floor surface may be adjusted through operation of the adjustment means 38. This is accomplished simply by grasping the handle 48 and removing the pin 54 from contact between the sprocket and base frame. The handle can now be turned to raise or lower the ball support frame to a new selected height. The user may hold the ball at this point or the pin can be replaced to lock the adjustment in position until further adjustment is desirable.

Upon completion of the training exercise, the apparatus is easily and quickly removed from the support structure simply by first pulling the pin of the pin and clip assembly 42 to release the upright portion of the ball support frame. The ball support frame can now be lifted easily from engagement with the bracket 39 and moved separately to a storage facility.

The remaining base frame 18 is disengaged simply by pulling out and downwardly on the handle 27 to shift the mounting bracket assembly 22 back to its inoperative position. In doing so, the link 31 moves in a downward direction releasing tension on the spring 34. The second hook member 24 is then free to move longitudinally away from the first hook member and disengage the lower rung 15 of the referee stand. The bottom end of the base frame may now be tipped away from the referee stand. The top hook 23 is removed simply by lifting the frame upwardly. The unit is now completely removed from the referee stand and may be stored for future use. The referee stand can now be used as desired.

It is pointed out that the present preferred form of ball setting apparatus 10 can be mounted and dismounted from the referee stand without requiring modification or alteration of the stand. The stand can therefore be used to support the present setting apparatus 10 during practice, then as a referee stand during actual play.

Figure 8:
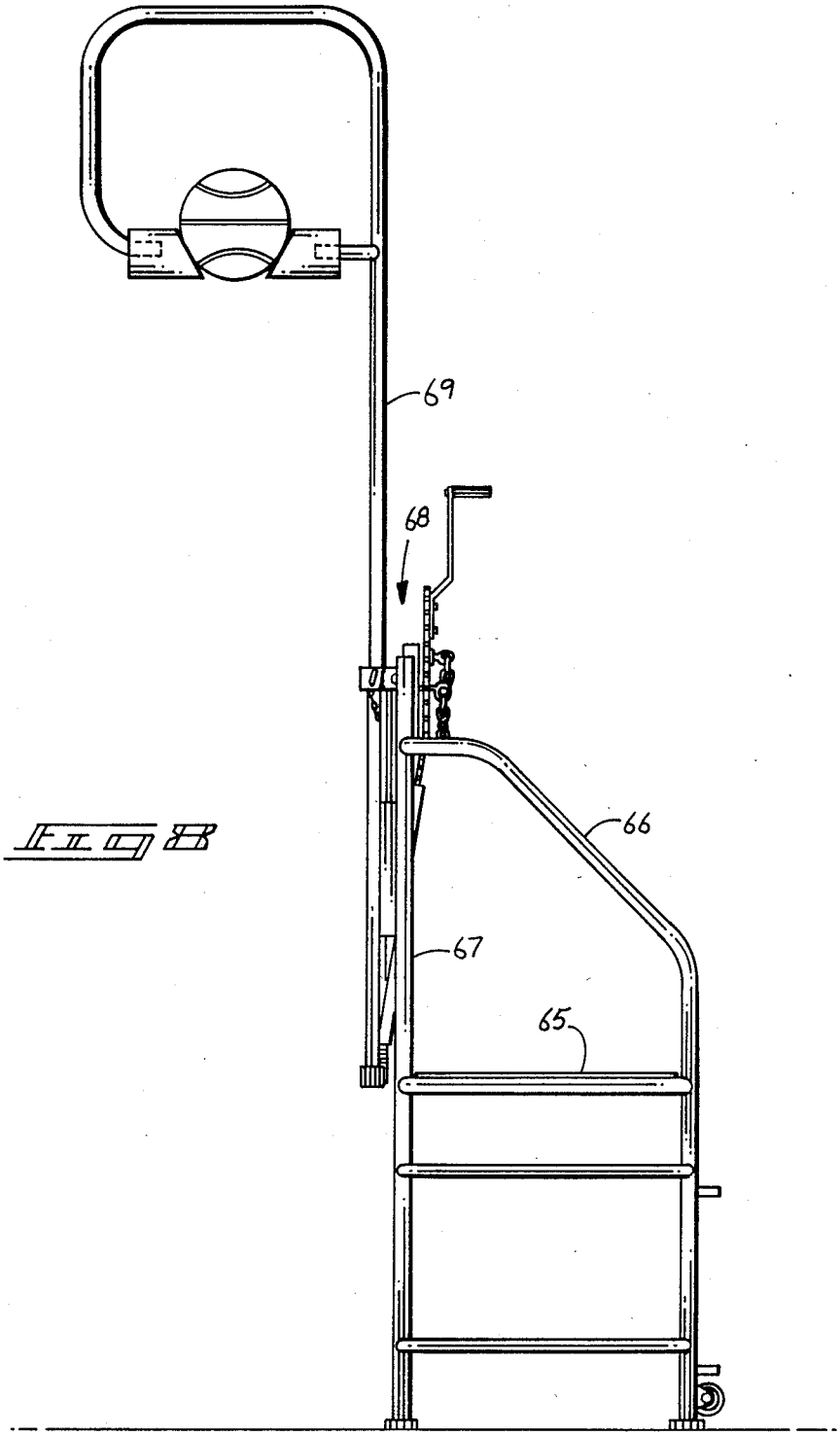
FIG. 8 is a side elevation view of an alternate form in which the ball setting apparatus includes a support structure.

An alternate form of the present invention is shown in FIG. 8 wherein a user support platform 65 on an upright support structure 66 are provided integrally with base frame 67 and height adjustment means 68. The base frame 67 and height adjustment means 68 adjustably and releasably support a ball support frame 69 that may be substantially identical to the frame 16 described above. In this version, the base frame 67, being integrated with the platform 65 and support frame 66, may be substantially identical to the base frame 18 with the exception that no base frame mounting bracket assembly is provided. The adjustment means 68 may be substantially identical to the adjustment means 38 of the preferred form.

A variation envisioned within the scope of this disclosure might further provide the ball support frame as an integrated part of the adjustment means. The entire structure would then be unitized. Other variations may also be envisioned. However, it is preferable that the ball support frame be removable to enable other used for the support structure 66 and platform 65, for example, as a volleyball referee stand.

Operation of the alternate version is substantially identical to operation of the preferred form disclosed above, with the exception that the steps involving mounting and dismounting the base frame to the stand are no longer required. The ball support frame is simply mounted to the adjustment means 68 for use in the same manner as described above. Following use, the ball support frame is dismounted using the same procedure as described above for the preferred form.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A game ball setting apparatus releasably mountable to a volleyball referee stand having an elevated user support platform, comprising:

a base frame member;

mounting means on the base frame member adapted to secure the base frame member to the volleyball referee stand adjacent the elevated user support platform thereon;

a ball support frame for receiving and releasably supporting a game ball for release responsive to contact by a player; and an adjustment means mounting the ball support frame on the base frame member adapted for access by a user from the elevated user support platform and for selectively adjusting the elevation of the ball support frame.

2. The apparatus of claim 1 wherein the mounting means is comprised of:

a first member on the base frame member adapted to engage the volleyball referee stand;

a second member adapted to engage the volleyball referee stand; and a clamp assembly mounting the second member to the base frame for selective movement on the base frame to grip the volleyball referee stand between the first and second members and thereby releasably secure the base frame to the volleyball referee stand.

3. The apparatus of claim 2 wherein the second member is slidably mounted to the base frame and the clamp assembly is comprised of:

a toggle linkage including a handle pivoted at one end situated on the base frame and extending to a handgrip at a remaining end;

a tension spring having one end operably mounted to the handle and a remaining end mounted to the second member; and wherein the handle is pivotable on the base frame between an inoperative position wherein the spring is relaxed to allow sliding movement of the second member on the base frame away from the first member and an operative position wherein the spring yieldably pulls the second member toward the first member.

4. The apparatus of claim 2 wherein the base frame is elongated and the adjustment means is comprised of:

a ball support frame mounting bracket mounted to the base frame for movement along the length thereof and for receiving and movably mounting the ball support frame to the base frame;

a linkage connecting the ball support frame mounting bracket to the base frame for manual operation to selectively move the ball support frame mounting bracket and ball support frame along on the base frame.

5. The apparatus of claim 1 wherein the base frame is elongated and the adjustment means is comprised of:

a ball support frame mounting bracket mounted to the base frame for movement along the length thereof and for receiving and movably mounting the ball support frame to the base frame;

a linkage connecting the ball support frame mounting bracket to the base frame for manual operation to selectively move the ball support frame mounting bracket and ball support frame along on the base frame.

6. The apparatus of claim 5 wherein the linkage is comprised of:

a sprocket rotatably mountable to the base frame;

a handle mounted to the sprocket to facilitate manual rotation thereof; and a chain having one end mounted to the sprocket and extending over the sprocket to a remaining end attached to the ball support frame mounting bracket.

7. The apparatus of claim 6 further comprising a number of apertures formed through the sprocket; and lock pin selectively receivable through any one of the apertures to engage the base frame and prevent rotation of the sprocket.

8. The apparatus of claim 1 wherein the ball support frame is comprised of:

a rigid frame adapted to be mounted to the adjustment assembly; and a ball support surface thereon.

9. The apparatus of claim 1 wherein the adjustment assembly includes a ball support frame mounting bracket for releasably receiving the ball support frame for selective attachment and detachment to the base frame and wherein the ball support frame mounting bracket is movable along the base frame for selective elevational adjustment thereon.

10. The apparatus of claim 9 mountable to a referee stand having elevationally spaced horizontal rungs wherein the mounting means is comprised of:

a first hook member on the base frame member adapted to engage one of the elevationally spaced horizontal rungs;

a second hook member adapted to engage a different one of the elevationally spaced horizontal rungs, and a clamp assembly mounting the second hook member to the base frame for selective movement on the base frame to grip the engaged rungs between the first and second hook members and releasably secure the base frame to the volleyball referee stand.

11. A game ball setting apparatus releasably mountable to a volleyball referee stand having an elevated user support platform, comprising:

a ball support frame having a ball support surface thereon adapted to releasably receive and support a game ball; and means for releasably mounting the ball support frame for attachment to the volleyball referee stand with the ball support surface projecting outwardly therefrom for access by a user from the elevated user support platform of the volleyball referee stand and for selective operation by the user from the elevated user support platform to set a game ball on the support surface and to position the game ball and ball support surface at a selected elevation for contact by a player for practice purposes and for selectively releasing the ball support frame for removal to enable use of the platform for referee purposes.

12. The apparatus of claim 11 wherein the means for releasably mounting the ball support frame to the volleyball referee stand includes a base frame with clamp means thereon for releasably mounting the base frame to the volleyball referee stand.

13. The apparatus of claim 11 wherein the means for releasably attaching the ball support frame to the volleyball referee stand is comprised of:

an elongated base frame member;

a first mounting member on the base frame adapted to engage the volleyball referee stand;

a second mounting member on the base frame longitudinally spaced from the first mounting member adapted to engage the volleyball referee stand at a location thereon spaced along the base frame from the first mounting member; and clamp means between one of the mounting members and base frame for selectively urging the one mounting member to an operative position forcibly against the volleyball referee stand to secure the mounting members and base frame to the volleyball referee stand.

14. The apparatus of claim 13 wherein the clamp means includes an over-center toggle connecting the one mounting member to the base frame for selectively locking one mounting member in the operative position.

15. The apparatus of claim 13 wherein the ball support frame is removably mountable to the elongated base frame.

16. The apparatus of claim 11 further comprising: an elongated base frame;

a ball support frame mounting bracket mounted to the base frame for movement along the length thereof and for receiving and movably mounting the ball support frame to the base frame;

a linkage connecting the ball support frame mounting bracket to the base frame for manual operation to selectively move the ball support frame mounting bracket and ball support frame along on the base frame.

17. The apparatus of claim 16 wherein the linkage is comprised of:

a sprocket rotatably mountable to the base frame;

a handle mounted to the sprocket to facilitate manual rotation thereof; and a chain having one end mounted to the sprocket and extending over the sprocket to a remaining end attached to the ball support frame mounting bracket.

18. The apparatus of claim 17 further comprising a number of apertures formed through the sprocket; and a lock pin selectively receivable through any one of the apertures to engage the base frame and prevent rotation of the sprocket.

19. A game ball setting apparatus, comprising: a volleyball referee stand structure including an elevated user support platform;

a ball support frame adjacent the elevated user support platform for receiving and releasably supporting a game ball placed by a user standing on the elevated user support platform for contact by a player; and an adjustment means releasably mounting the ball support frame on the volleyball referee stand adapted for access by a user from the elevated user support platform and enabling (a) adjustment of the elevation of the ball support frame from the elevated user support platform, and (b) selective removal of the ball support frame from the referee stand to thereby facilitate use of the referee stand structure as a referee stand.

20. The apparatus of claim 19 wherein the adjustment means includes a mounting bracket for releasably receiving and mounting the ball support frame to the volleyball referee stand structure.

21. A game ball setting apparatus for releasably mounting a game ball support to a volleyball referee stand having an elevated user support platform, comprising:

a base frame member including opposed ends;

mounting means on the base frame member for securing the base frame member to the volleyball referee stand adjacent the elevated user support platform thereof; and an adjustment means for releasably mounting the game ball support to the base frame member for selective access by a user standing on the elevated user support platform to enable the user to set a game ball on the game ball support and to selectively adjust the elevation of the ball support frame.

* * * * *